United States Patent [19]

Hegg et al.

[11] 4,021,973

[45] May 10, 1977

[54] PARTITION SYSTEM

[75] Inventors: Thomas R. Hegg, Michigan City, Ind.; Kenneth E. Reinhard, Severna Park, Md.

[73] Assignee: Interstate Industries, Inc., Mundelein, Ill.

[22] Filed: May 27, 1976

[21] Appl. No.: 690,409

[52] U.S. Cl. ..... 52/36; 52/239; 52/495; 52/738; 248/224.1; 248/223.4

[51] Int. Cl.[2] ..... A47G 5/00; A47G 29/02

[58] Field of Search ..... 52/36, 239, 282, 495, 52/738, 241, 238, 624; 248/221, 224; 160/135

[56] References Cited

UNITED STATES PATENTS

| | | | |
|---|---|---|---|
| 3,086,627 | 4/1963 | Bernard | 52/738 X |
| 3,374,597 | 3/1968 | Whitener | 52/738 |
| 3,462,110 | 8/1969 | Cheslock | 52/738 X |
| 3,841,042 | 10/1974 | Siegal | 52/495 X |
| 3,871,153 | 3/1975 | Birum | 52/239 X |
| 3,886,698 | 6/1975 | Raith et al. | 52/36 |
| 3,949,827 | 4/1976 | Witherspoon | 52/239 X |

*Primary Examiner*—J. Karl Bell
*Attorney, Agent, or Firm*—Glenn E. Klepac

[57] ABSTRACT

A partition system comprising a fixed standard and upstanding acoustical panels, with brackets affixed to the standard for securement of the panels thereto and for support of shelves and desk tops adjacent the panels. Connecting hardware securing panels to the brackets and standard is hidden from view. Panel faces are covered with fabric sheets, and panel frames are formed with outwardly directed channels accommodating splines wedging perimetric edge portions of the fabric sheets therewithin.

9 Claims, 11 Drawing Figures

PARTITION SYSTEM

BACKGROUND OF THE INVENTION

Several types of partition systems comprising upstanding panels and connecting elements are known in the prior art. However each of these prior art partition systems suffers from one or more disadvantages making it less than completely suitable for its intended purpose. For example, in one such system shelves and desk tops are affixed directly to side portions of the panels. In this prior art system it is necessary to constrict the panels of material which is sufficiently heavy to support the weight of such shelves and desk tops. In other prior art systems the connecting elements between adjacent panels are visible, resulting in an unsightly appearance.

It is a principal object of the present invention to provide a partition system of upstanding acoustical panels supported by elongated standards in which shelves and desk tops included in the system are supported by the standards rather than by the panels.

It is a related object of the invention to provide a partition system of upstanding panels in which the panels are relatively light in weight, and have a high noise reduction coefficient in relation to their weight.

It is a further object of the invention to provide a partition system including a plurality of upstanding panels, in which the connecting elements between end walls of adjacent panels are hidden from view.

Yet another object of the invention is to provide a panel for a partition system including an outer fabric sheet which can be readily replaced manually, without need for disassembly of the entire panel.

Other and further objects and advantages of the present invention will become readily apparent from the following specification, taken in conjunction with the drawings.

DESCRIPTION OF PREFERRED EMBODIMENTS

Figure 1:
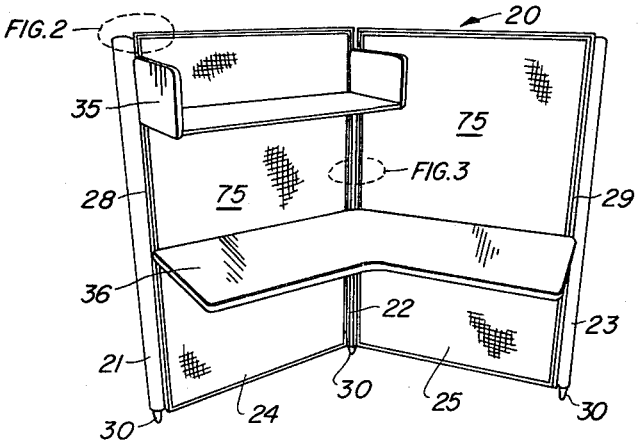
FIG. 1 is a front perspective view of a two-panel partition system constructed in accordance with the invention.

Referring first to FIGS. 1–4, a preferred embodiment of the partition system 20 of the invention includes three elongated standards 21, 22, 23 and a pair of panels 24,25 secured in an upright position between the standards. Two elongated brackets 16,17 are secured to the middle standard 22, joining that standard with adjacent end walls of the two panels 24,25. Single brackets 28,29 join lateral end walls of the panels 24,25 to the two lateral standards 21,23. Each of the three standards includes a post leveling device 30 threadably received in a bottom end portion.

In the preferred embodiments shown herein, all of the standards and brackets are elongated sections of extruded aluminum posts. The outer surface of each post is bronzed to enhance its appearance. The brackets 26, 27, 28, 29 are generally U-shaped in transverse cross-section and they each include a pair of spaced arms or arm portions 31,32 formed with vertical rows of through slots 33. These slots 33 are sized to accommodate hook portions of brackets (not shown) attached to shelves and desk tops. The partition system 20 is thereby capable of supporting a shelf 35 and a desk top 36 in a wide range of preselected positions, as shown in FIG. 1. The positions and sizes of shelves and desk tops utilized can be adjusted to suit the needs and preferences of each individual user of the system.

Figure 4:
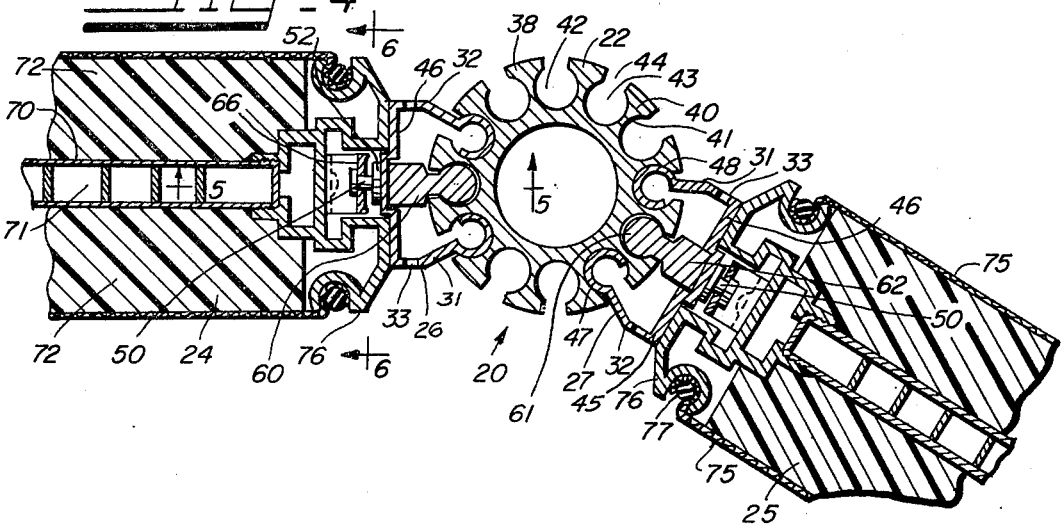
FIG. 4 is a fragmentary cross-sectional view taken along the line 4—4 of FIG. 3.

In FIG. 4 it is seen that the middle standard 22 includes twelve walls or wall means 38 arranged symmetrically about a generally cylindrical central hub 39. Each wall 38 is generally T-shaped in transverse cross-section and includes a head or head portion 40 spaced from the hub 39, and a neck or neck portion 41 intermediate the hub 39 and head portion 40. The twelve walls 38 form boundaries of twelve symmetrical keyways 42, each of which opens radially outwardly of the standard 22. Each keyway 42 consists of an inner chamber 43 adjacent the hub 39, and a passageway 44 which is narrower than the inner chamber 43.

The brackets 26, 27, 28, 29 each include a generally U-shaped yoke 45 comprising a pair of spaced arms 31, 32 and a bight or bight portion 46. End portions of the arms 31,32 are formed with spaced parallel rails 47, 48 which are generally crescent-shaped in transverse cross-section and sized for longitudinal insertion within corresponding inner chambers 43 of the keyways 42. The arms 31, 32, being narrower than the rails 47, 48, extend through the passageways 44 of the keyways 42.

Figure 10:
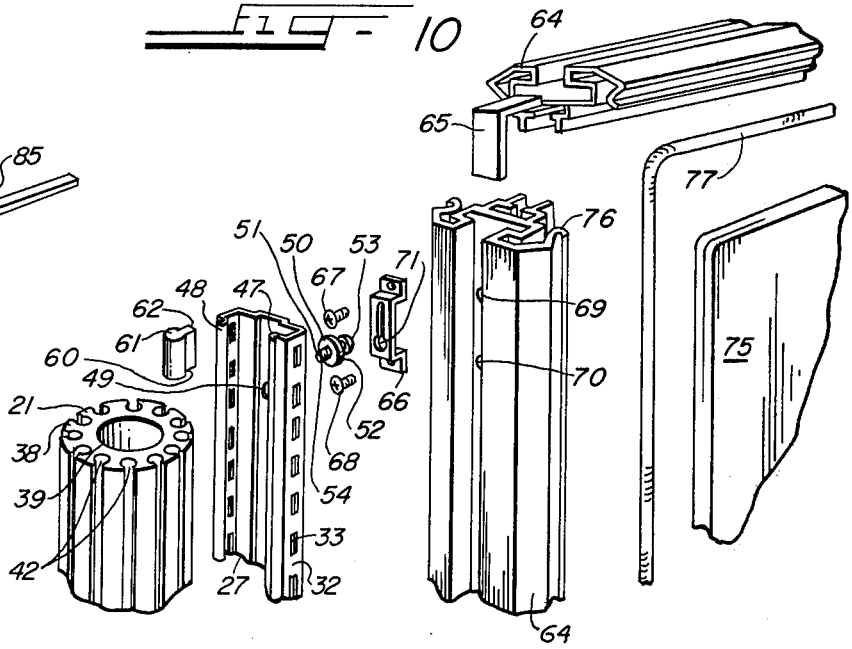
FIG. 10 is an exploded, fragmentary perspective view corresponding to FIG. 2, illustrating a standard, a panel, and a key, bracket, pin and clip for securing the panel to the standard.

Referring now more particularly to FIGS. 4 and 10, the bight portion 46 of the yoke is formed with a pair of transverse through openings 49, only one of which is illustrated. These openings 49 are sized to permit passage of a pin means or pin 50 therethrough. The pin 50 is characterized by a shaft 51, a flange 52 extending radially outward of the shaft 51, a projection 53 on an outwardly directed free end of the shaft 51, and screw threads 54 between the flange 52 and a second end of the shaft 51.

Figure 5:
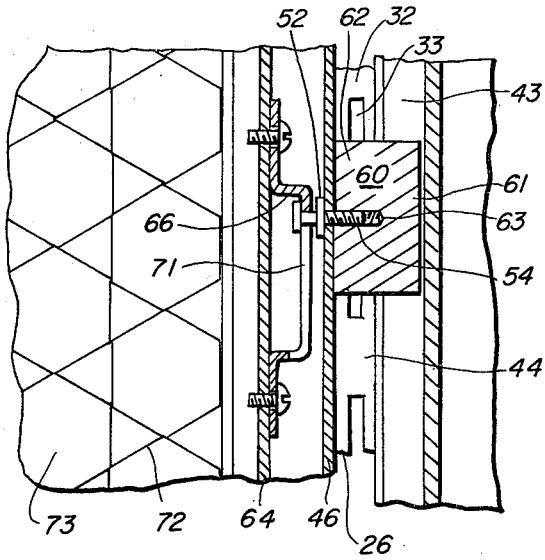
FIG. 5 is a fragmentary cross-sectional view taken along the line 5—5 of FIG. 4.
Figure 6:
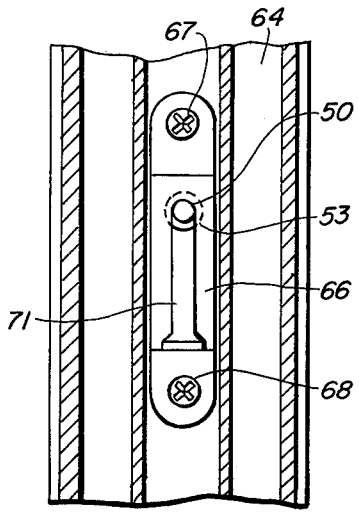
FIG. 6 is a cross-sectional view taken along the line 6—6 of FIG. 4.

Referring now to FIGS. 4, 5 and 10, a key 60 is inserted in a keyway 42 in the standard 21 between the two parallel rails 47, 48 on the bracket 27. This key 60 includes a boss or boss portion 61 adapted for slidable insertion longitudinally within an inner chamber 43 of the keyway 42, and a lug or lug portion 62 narrower than the boss and adapted to project through a passageway 44 of this keyway 42. The lug 62 is formed with an outwardly opening transverse bore 63 having screw threads adapted to mate releasably with corresponding threads 54 on the pin 50.

A bracket 26 is secured to the standard 22 by sliding a pair of rails 47, 48 into a corresponding pair of keyways 42, and by inserting pins 50 through both openings 49 in the bight portion 46 of the bracket 42. Each pin 50 is screwed into the bore 63 of a corresponding key 60 which has been inserted into a keyway 42 bridged by the bracket 26. A principal face of the flange 52 on the pin 50 abuts against an outer face of the bight portion 46 of the bracket 26, thereby firmly securing the bracket 26 to the standard 22. A second bracket 27 is similarly secured to the standard 22, utilizing three other passageways 42.

Each panel 24,25 is bordered by a segmented, extruded bronzed aluminum frame 64, as illustrated in FIGS. 4, 5, 6 and 10. Top and side segments of the frame 64 are joined through an L-shaped corner bracket 65, as shown in FIG. 10. Clips or clip means 66 are secured to an end face of the frame 64 by means of screws 67, 68 inserted in screw holes 69,70 in the frame 64. Each clip 66 defines a keyway-shaped opening 71 adapted to accommodate a corresponding projection 53 on a pin 50 extending away from a bracket 27. When two of the projections 53 mate with corresponding openings 71 in the clips 66, the panel 25 is locked securely in abutment with the bracket 27.

Each panel includes a walled core 72 defining a plurality of hollow cells 73. In the preferred embodiments shown, the walls of these cells are constructed of cardboard. The core 72 is flanked on opposed sides by a sound-absorbing layer of light weight fiberglass padding 74 which is spot-glued to sides of the core 72. Outer surfaces of the panels are covered by colored burlap sheets 75 having a flexible plastic backing for increased resistance to fire.

Figure 2:
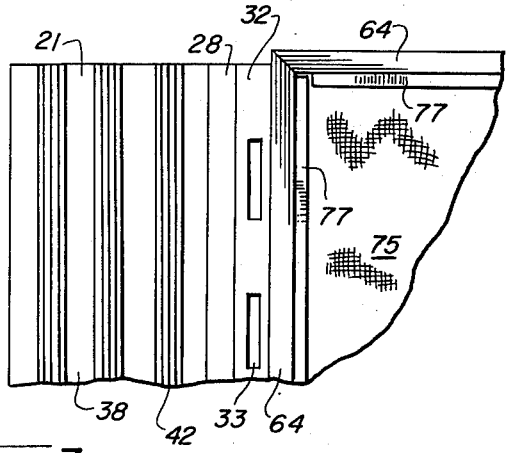
FIG. 2 is an enlarged fragmentary view of a corner portion of one of the panels of FIG. 1.
Figure 3:
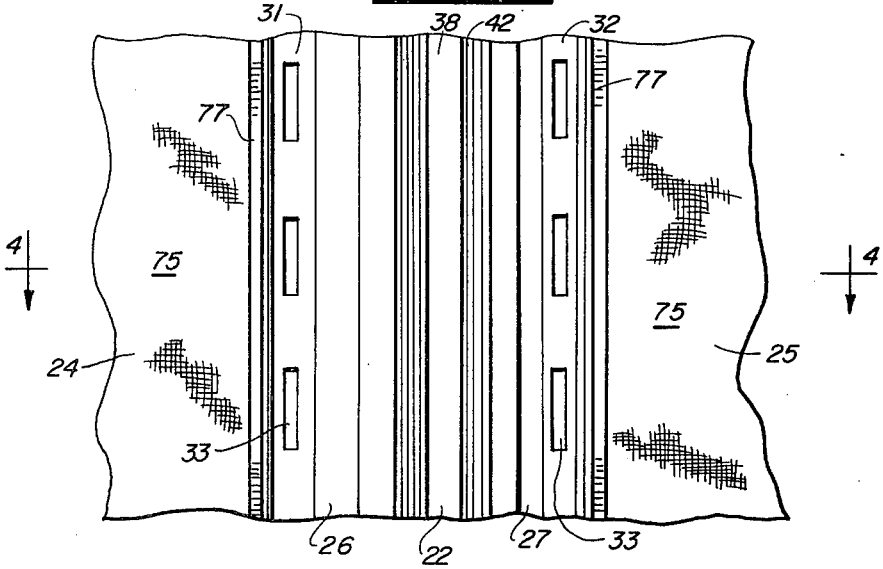
FIG. 3 is an enlarged fragmentary view of the standard of FIG. 1, showing portions of two panels secured to the standard.
Figure 7:
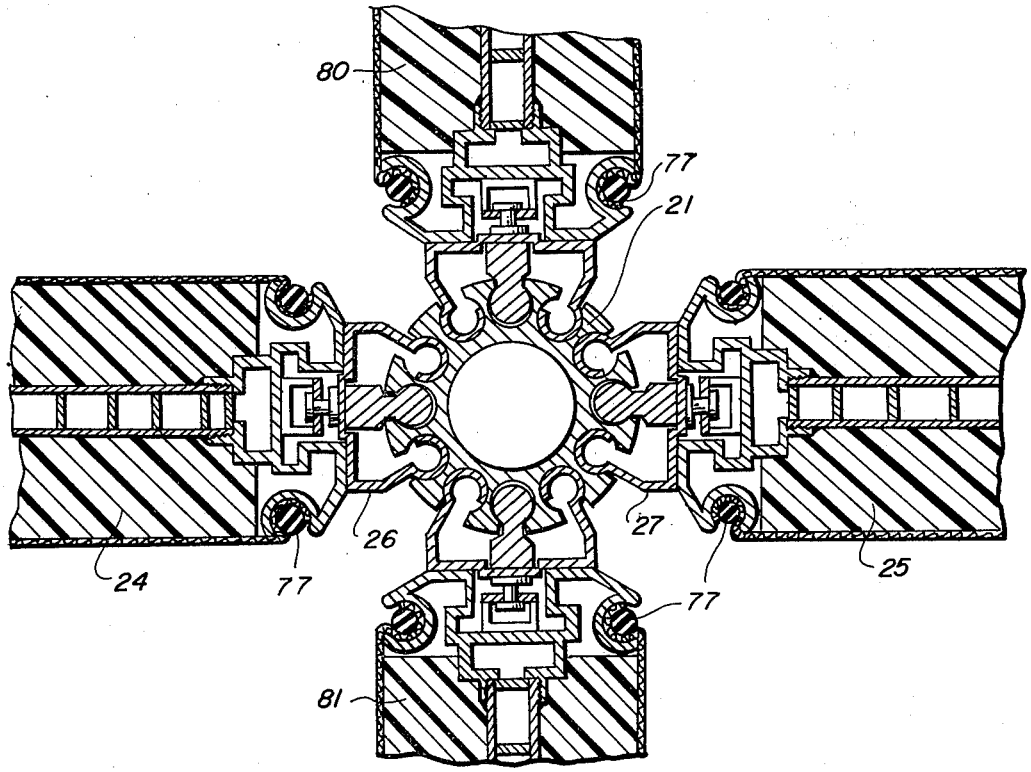
FIG. 7 is a fragmentary cross-sectional view of a second embodiment of the invention, comprising a four-panel partition system supported by a single standard.

Referring now to FIGS. 2, 4 and 7, marginal perimetric portions of the outer sheet 75 are placed within shallow channels 76 defined by the frame 64. A flexible, hollow tubular plastic spline 77 is wedged within the channels 76 together with margins of the sheets 75. This spline 77 is readily removeable manually, thereby providing a convenient means for replacement or cleaning of the outer sheets 75 without disassembling the entire panel.

Each standard 21 of the invention is adapted to receive and support as many as four brackets and panels, as illustrated in FIG. 7. In this embodiment two additional panels 80,81 have been added to the two panels 24,25 of FIGS. 1–4.

Figure 8:
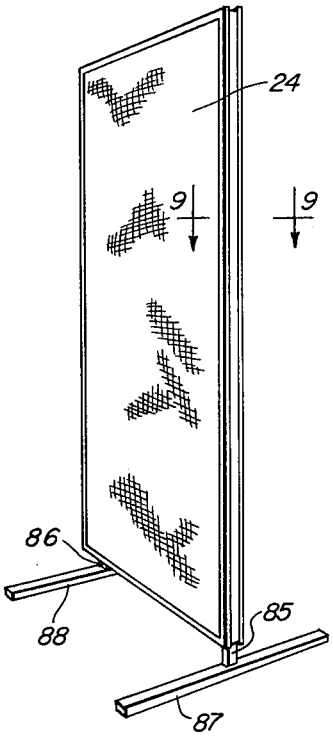
FIG. 8 is a perspective view of a third embodiment of the invention, comprising a single upstanding panel supported by a pair of standards.
Figure 9:
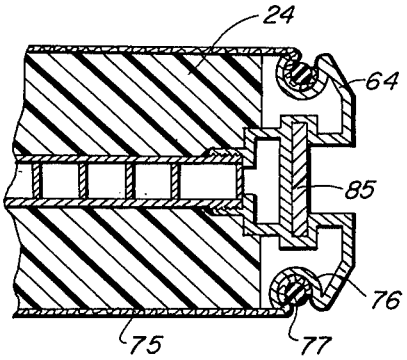
FIG. 9 is an enlarged, fragmentary cross-sectional view taken along the line 9—9 of FIG. 8.

A single panel version of the partition system of the invention is illustrated in FIGS. 8 and 9. The single panel 24 is supported by a pair of posts 85,86, each of which is affixed to a floor support 87,88.

Figure 11:
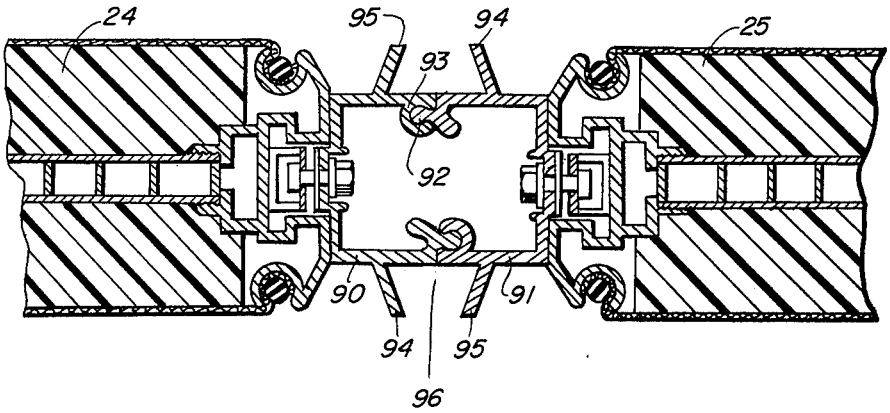
FIG. 11 is a fragmentary cross-sectional view of a fourth embodiment of the invention, illustrating a pair of extruded metal brackets interconnecting end portions of two adjacent panels.

The panels 24,25 of the invention can be interconnected through special end brackets 90,91 as shown in FIG. 11. These brackets 90,91 are secured to one another through mating tabs 92 and slots 93, as shown, thereby eliminating the need for more expensive standards to interconnect the panels 24,25. Outer faces of the end brackets are formed with wing tabs 94,95 defining a wire raceway 96 for bringing electricity to applicances and lamps located on or near the panels.

The foregoing description of preferred embodiments of our invention is for purposes of illustration only, and several of the structural features described may be modified in ways which do not involved any departure from the spirit and scope of the invention as defined by the following claims.

What is claimed is:

1. In a partition system comprising an elongated standard including a central hub and a plurality of wall means extending radially outwardly of said hub, said wall means defining a plurality of parallel longitudinally extending keyways generally coextensive with the standard, each said keyways including an elongated hollowed out inner chamber and an elongated passageway narrower than said inner chamber and communicating therewith, said passageway opening radially outwardly of the standard, an upstanding panel, and securement means for releasably securing said panel to the standard;

the improvement wherein said securement means comprises a bracket including a pair of elongated spaced parallel rails adapted for cooperative slidable longitudinal insertion within a corresponding pair of said inner chambers of the keyways in the standard, said bracket further including a yoke joining said rails, said yoke being formed with a transverse through opening;

pin means and means detachably affixing said pin means to the standard, said pin means being adapted to project through the opening in said yoke; and clip means affixed to an end face of said panel, said clip means being adapted to engage said pin means releasably, thereby to secure the panel to the standard.

2. The improvement as set forth in claim 1, wherein the wall means in said standard define at least three longitudinally extending keyways, and wherein the pin means in said securement means comprises a shaft passing through the through opening in said bracket, a flange projecting radially outwardly of the shaft and having a principal face paralleling and in abutment with an outer face of the yoke of said bracket, and a projection on an outwardly directed end of said shaft, said projection being adapted releasably to engage the clip means affixed to said panel to secure said panel to said standard;

said improvement further comprising a key including a boss adapted for slidable insertion lingitudinally within an inner chamber of a keyway bridged by said bracket, and a lug affixed to said boss and adapted to extend through a passageway of said third keyway, said lug including attachment means adapted to mate releasably with the shaft of said pin means.

3. The improvement as set forth in clain 2, wherein said pin means comprises a screw fastener having threads between said flange and an inwardly directed end thereof, and wherein said attachment means on said lug comprises an outwardly opening transverse bore having screw threads adapted to mate releasably with the threads on said screw fastener.

4. The improvement as set forth in claim 2, wherein said boss has a transverse dimension greater than the width of each passageway in said standard.

5. The improvement as set forth in claim 1 wherein the standard comprises a generally cylindrical extruded metal post having a generally cylindrical hollowed out central hub coaxial and coextensive with said standard, each said wall means being generally T-shaped in transverse cross-section and comprising a head portion spaced from said hub, and a neck portion intermediate said hub and said head portion.

6. The improvement as set forth in claim 1, wherein said standard comprises twelve wall means defining twelve symmetrically arranged, radially outwardly opening keyways, said standard thereby being adapted to interconnect a plurality of upstanding panels in a wide variety of preselectable angular relationships.

7. The improvement as set forth in claim 1, wherein said panel comprises a fabric sheet covering an outer principal surface thereof;

a frame generally circumscribing said fabric sheet, said frame defining a channel opening outwardly thereof; and a resilient spline wedged within said channel together with perimetric edge portions of said fabric sheet, whereby said fabric sheet is readily manually replaceable upon disengagement of said spline from said channel.

8. The improvement as set forth in claim 1, wherein each said rails in said bracket has a transverse dimension greater than the width of each passageway in said standard, and wherein the yoke of said bracket is generally U-shaped in transverse cross-section and includes a pair of longitudinally extending arms adjoining said rails, each said arms passing through a passageway in the standard, and a longitudinally extending bight portion connecting said arms.

9. The improvement as set forth in claim 8, wherein at least one of said arms defines a vertical row of slots adapted to receive shelf hooks, whereby said bracket is adapted to support a shelf proximate said panel in several different preselected positions.

* * * * *